United States Patent [19]

Uhlyarik

[11] 4,217,877

[45] Aug. 19, 1980

[54] ENERGY-SAVING FORCED-AIR FURNACE

[76] Inventor: Emanuel J. Uhlyarik, 23309 Westbury Dr., St. Clair Shores, Mich. 48080

[21] Appl. No.: 946,153

[22] Filed: Sep. 27, 1978

[51] Int. Cl.[2] ..... F24H 3/00; F28D 17/00

[52] U.S. Cl. ..... 126/99 R; 110/323; 110/326; 126/99 D; 126/110 AA; 126/110 R; 126/400; 165/10

[58] Field of Search ..... 126/99 R, 99 D, 110 R, 126/106, 176 A, 110 AA, 400; 165/10, DIG. 2; 432/223; 110/323, 326

[56] References Cited

U.S. PATENT DOCUMENTS

| | | | |
|---|---|---|---|
| 781,308 | 1/1905 | Smith | 126/99 D |
| 2,033,208 | 3/1936 | Shrum | 126/99 R |
| 2,164,377 | 7/1939 | Bertossa | 126/99 R |
| 2,231,227 | 2/1941 | Scott | 126/99 R |
| 2,252,784 | 8/1941 | Powers | 126/99 R |
| 2,485,386 | 10/1949 | Kozenski | 126/99 R |
| 2,742,896 | 4/1956 | Schack et al. | 126/99 R |
| 2,858,781 | 11/1958 | Hexdall | 126/99 D |
| 4,147,303 | 4/1979 | Talucci | 126/99 D |

*Primary Examiner*—James C. Yeung
*Assistant Examiner*—Daniel J. O'Connor
*Attorney, Agent, or Firm*—Dolgorukov & Dolgorukov

[57] ABSTRACT

The specification discloses a novel energy saving forced-air furnace. In contrast to previous forced-air furnaces, which ran only on gas or oil and in which approximately half of the energy derived from the burning fuel was lost through the chimney, the furnace of the present invention can run on coal, wood, gas or oil and retains a substantial portion of the heat which normally would be lost by the utilization of special tubing units and refractory plates. My furnace saves the greatest amount of energy possible by providing a heat chamber having a special tubing unit therein from the surface area of which heat generated in a stove chamber is transferred to a heat chamber and simultaneously through which exhaust gases air conducted from the stove chamber mounted below the heat chamber to the exterior of the furnace. Refractory plates are placed in a serial arrangement within the furnace heat chamber with spaces provided between them. The purpose of the spacing between each refractory plate is to allow for efficient air circulation within the furnace heat chamber so that the energy transmitted by the hot gases as they enter the heat chamber via the specially designed tubing unit may be transferred to and stored by the refractory plates during intervals when the blower is not operating and heat drawn from them when the blower is activated. Thus, my novel energy saving forced-air furnace can operate on a steady slow burning fire such as a coal or wood fire, without loss of energy, or use the more conventional gas or oil firing means by drawing heat from the refractory plates after the burner is shut off by the thermostat, until the plates cool, and substantially reduce the amount of energy currently being wasted by conventional modern furnaces.

15 Claims, 13 Drawing Figures

28
66
86
4
58
21
5
24
27
30
90
65
65a
67
63
22
23
26
70
72
20
64
76
19
5
34
25
97
50
96
53
55
54
45
56
59
41
4

Fig-2
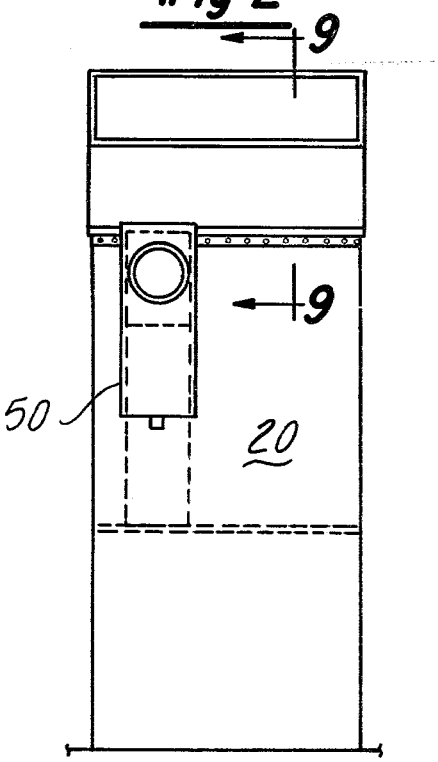
Fig-3
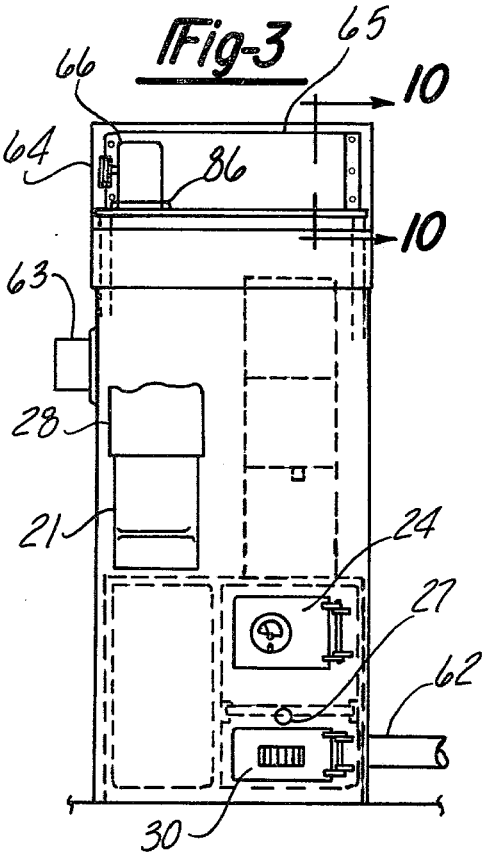
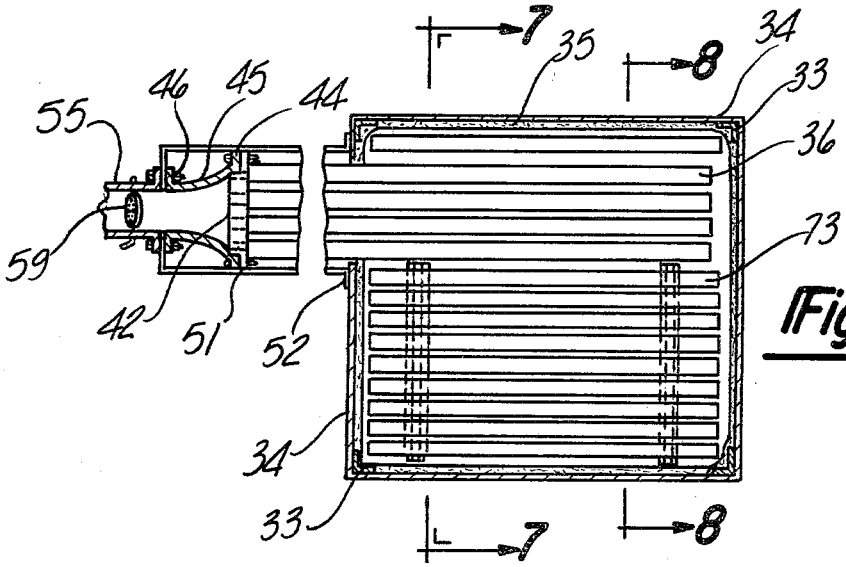
Fig-4

ENERGY-SAVING FORCED-AIR FURNACE

This invention relates to furnaces, and more particularly to an improved energy saving forced-air furnace which may be fired by any of the present day furnace fuels interchangeably, such as coal, the abundance of which is well known, wood, the only growing fuel, oil or gas.

It has long been the practice in the furnace art to allow the gases heated by whichever fuel is being used to directly escape through the venting system and out the chimney, thus resulting in a substantial waste of energy.

In general, the furnaces known in the art, consist of two separate chambers, one within the other, but entirely segregated. The inner chamber, usually constructed of cast iron or steel, encloses the space in which combustion occurs where the heat is extracted from the flue gases. The entire assembly is completely enclosed by a casing ordinarily made of galvanized iron, or light gauge sheet steel to form a heat chamber. In this system, the air passes between two chambers where it absorbs the heat from the surface of the inner assembly. It is then usually conveyed by means of hot air ducts to rooms being heated by means of a motor-driven blower in a mechanical warm air heating system. After giving up its heat, the air is returned to the furnace by means of cold air ducts at a temperature slightly below that of the room.

While the conventional forced-air furnace did attempt to utilize some of the heat lost up the chimney by continuing operation of the blower after the gas or oil burner had shut off, drawing heat from the furnace until it cooled, since the capacity to store energy within the inner chamber of the typical furnace is very limited, not much escaped heat is saved by this method. In complete contrast, by the use of my present invention which permits the furnace to operate with a reduced fire by utilizing all possible retained heat and circulating it through a house by use of vacuum and a blower, much heat is stored in the refractory plates and used later. Thus, when using oil or gas much less heat is wasted, and one is also given the option of using coal or wood slow burning fires.

In the past, when the fuel supplies were readily abundant and cheap, the major concerns or objectives in planning of a forced-air furnace system was to obtain the greatest quantity of heat from a given quantity of fuel; to concentrate the heat and direct it to the areas to be used, and to provide the ability to easily and conveniently regulate, at the pleasure of the building occupant, the necessary degree of heat.

However, today the major concern or objective in planning of a forced-air furnace system is to prevent the dissipation of the heat after it is produced, especially the heat lost out the chimney.

Until recently, the heat loss associated with the loss of energy from the hot waste gases that are transmitted directly from the combustion chamber of the furnace to the chimney has been ignored because of the much easier problem of solving heat loss problems such as those caused by direct transmission of heat through building materials or air leaks through windows, etc.

The novel use of refractory plates within the hot air chamber of a forced-air furnace, and design improvements in the furnace and the flue tubing unit, as disclosed by the specification below, provides a novel and improved energy saving forced-air furnace.

Accordingly, one of the objects of the present invention is to provide a furnace in which coal or wood is used in connection with a forced-air heating system.

Another object of the present invention is to provide an improved energy saving forced-air furnace which uses the heat contained in the hot gases which escape through the chimney.

Another object of the present invention is to provide an improved energy saving forced-air furnace designed to reduce the amount of energy lost through the chimney.

Another object of the present invention is to provide an improved furnace which has refractory plates within the furnace that can store a substantial amount of the energy contained in the hot gases that are normally released through the chimney.

A still further object of the present invention is to provide an improved forced-air furnace which uses coal as a fuel.

Another object of the present invention is to provide an improved forced-air furnace which uses wood as a fuel.

Another object of the present invention is to provide an improved forced-air furnace which uses oil as a fuel.

Another object of the present invention is to provide an improved forced-air furnace which uses natural gas as a fuel.

A still further object of the present invention is to provide an improved energy saving furnace which can be fired by any fuel or combination of fuels.

Another object of the present invention is to provide an improved forced-air furnace which uses less fuel due to slow burning fires, thereby causing less air pollution, is inexpensive to maintain and operate, and which needs less attention than previous coal furnaces.

Further objects and advantages of this invention will be apparent from the following description and appended claims, reference being had to the accompanying drawings forming a part of the specification, wherein like reference characters designate corresponding parts in the several views.

FIG. 2 is a back elevational view of the construction shown in FIG. 1.

FIG. 3 is a front elevational view of the construction embodying the present invention shown in FIG. 1.

FIG. 4 is a sectional view taken in the direction of the arrows on the section line 4—4 of FIG. 1, with the top of the furnace removed showing a plan view of the hollow flue tubing unit and the refractory plates.

It is to be understood that the invention is not limited in its application to the details of construction and arrangement of parts illustrated in the accompanying drawings, since the invention is capable of other embodiments and of being practiced or carried out in various ways within the scope of the claims. Also, it is to be understood that the phraseology and terminology employed herein is for the purpose of description and not of limitation.

Referring to FIGS. 1–9, applicant discloses a construction embodying his novel energy saving forced-air furnace 20, which for illustration purposes is shown as being coal fired. It is to be understood that Applicant's invention is capable of being utilized in other embodiments which use any of the many available fuels and methods of firing. The variety of fuels include, solids (wood and coal), liquid (oil and benzo) and gaseous (natural gas or producer gas) or any combinations thereof. The coal fired furnace is preferred because of the fuel's low economic costs and its easy availability.

Figure 1:
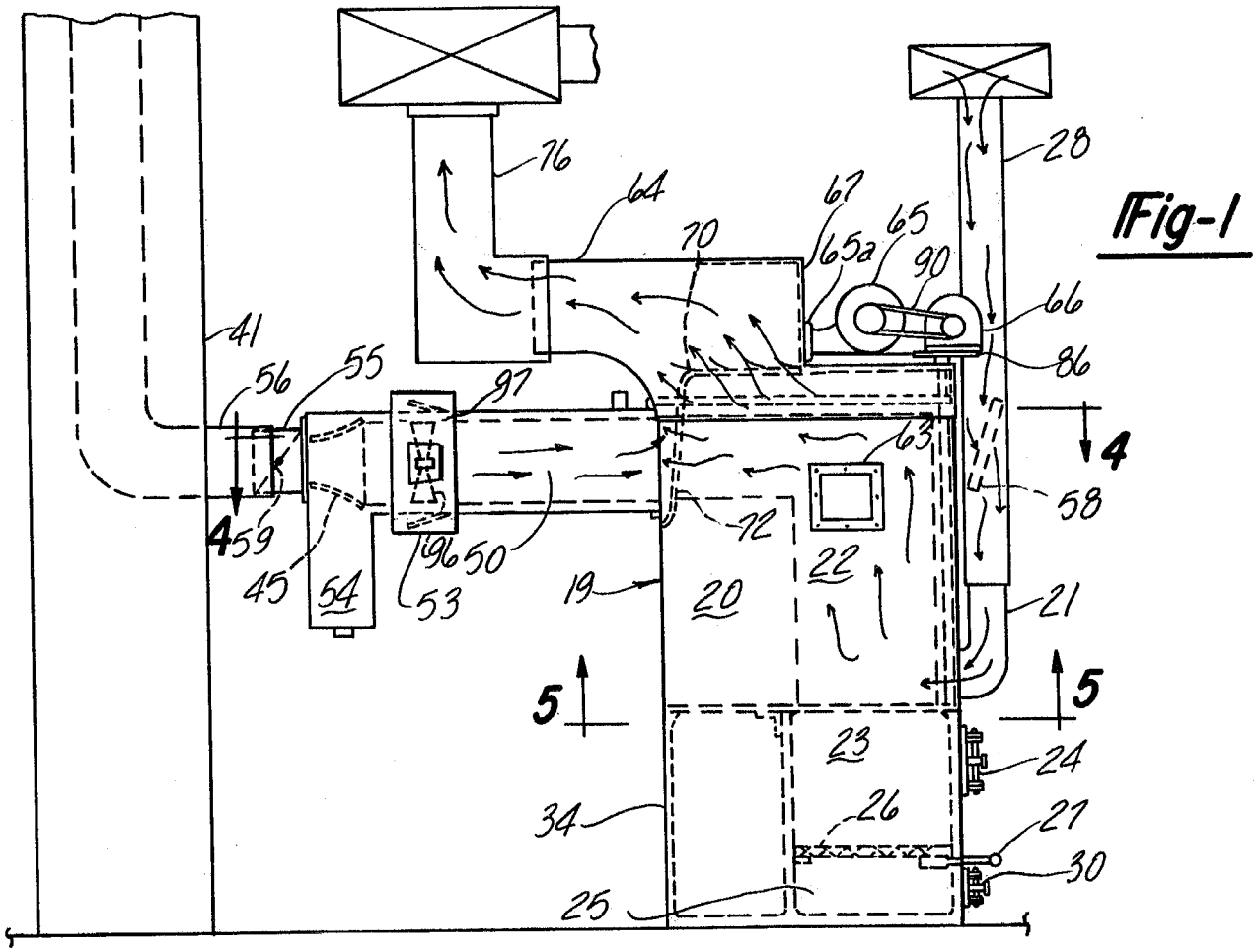
FIG. 1 is a left-side elevational view of a construction embodying the present invention.
Figure 5:
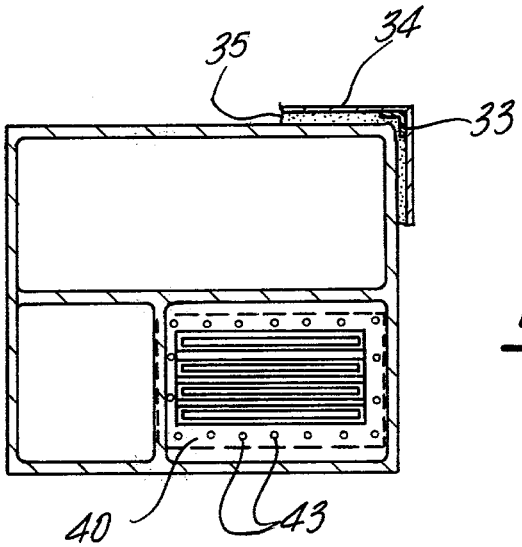
FIG. 5 is a sectional view taken in the direction of the arrows on the section line 5—5 of FIG. 1, showing the interior of the furnace and the inlet of the hollow flue tubing unit.

Referring to FIG. 1, there is disclosed a left-side elevational view of a coal fired forced-air furnace 20. There is shown a furnace housing generally designated by the numeral 19 having sidewalls 34 preferably formed of sheet steel. The sidewalls are fastened by suitable means, such as spot welding, etc., to vertical steel angles 33. A plurality of flanges 32 permit a heavy steel refractory supporting plate plate 31 to be mounted to the sidewalls of the furnaces and divide the housing into an upper heat chamber portion 22 and a lower portion as well as providing additional structural support for the sidewalls.

A means to allow air to enter the lower end of the heat chamber and be circulated through the furnace in a manner to be described is provided in the form of a cold air return 21 in which there may be mounted an air filter 58. A stove chamber 23 is adapted to be fitted through a suitable opening in said housing 19 (not shown) and to be positioned adjacent a flanged opening 39 in said plate 31.

The stove chamber 23 includes a filler door 24 through which the furnace 20 is manually or automatically stoked. Under the stove chamber is an ash compartment 25 into which the ashes fall from the grates 26 when grate shaking means 27 are activated. Ashes are removed through the ash compartment door 30.

Figure 6:
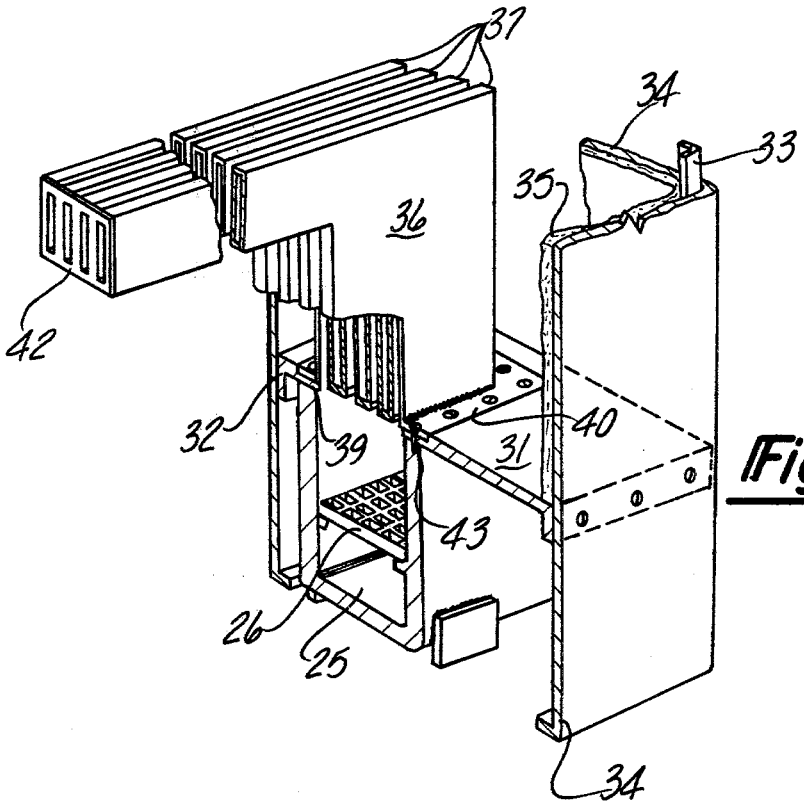
FIG. 6 is a perspective view, partially broken away, showing the stove chamber and the hollow flue unit.

Referring to FIG. 6, a hollow right angle tubing unit having a spacer plate 40 complimentary in shape to said flanged opening 39 is operatively positioned therein and sealingly attached to said flange and said stove chamber by suitable fastening means, such as bolts 43.

To the inside of the steel sheet covering 34, which acts as the furnace housing, is attached insulation 35, which minimizes the convection heat loss.

Applicant has found the preferred embodiment of the heat tubing unit 36 to be one constructed from a noncorrosive light gauge sheet steel material, and consisting of many rectangular right angle hollow tubes 37 serially spaced. The number and the size of the rectangular right angle hollow tubes 37 will vary according to the amount of heat required to service the house and to be drawn from the surface area of the tubing enclosed in the heat retaining housing 50 immediately before venting into the chimney.

An acceptable size and shape of the rectangular hollow tubing 37 has been found to be of a width of three quarters ($\frac{3}{4}$) of an inch, with a spacing of one half ($\frac{1}{2}$) of an inch between each rectangular-shaped hollow tube 37. The tubing unit 36 acts as a conduit for the smoke and gases as they rise from the stove chamber 23 and eventually out of the chimney 41. The use of multiple hollow flue tubes 37, instead of one (1) cylindrical-shaped flue, is done for the purpose of increasing the surface area of the tubing unit 36, with which hot gases have contact with, therefore substantially increasing the effectiveness of the convection heat transfer between the air in the heat chamber 22 and the tubing unit 36.

The individual tubes 37 are connected together as a tubing unit 36 by welding a metal lower spacer plate 40 and an upper spacer plate 42 to both ends of the tubing unit 36 (see FIG. 6).

It is important that both ends of tubing unit 36 be completely sealed so that no noxious gases can enter the heat chamber 22; standard methods of testing of the tubing unit 36, known in the art, are done to insure one hundred percent (100%) sealing is accomplished. The tubing unit 36, as discussed above, is then sealingly attached to the top of the square steel plate 31 by means of bolts 43. Referring to FIG. 4, it can be seen that a means to allow ashes, smoke and unwanted gases to exit the tubing unit are provided. Such means include a funnel-shaped conduit 45, which is suitably connected to one side of ash retainer 54 by means of angular-shaped flanges 46 located at the end of the funnel-shaped conduit 45.

The heat retaining housing 50 is slipped over and rests on the outer flange 51 of the upper spacer plate 42 and is suitably connected by flanges 52 to the steel sheet covering 34 on the back of the forced-air furnace 20. The heat retaining housing 50 is provided with vent openings 53 contained within a housing 97 for purposes to be described. The vent openings should preferably be of a construction to aid air to be forced toward the front of the furnace.

An ash retainer unit 54 is attached to the flange of the spacer plate 42 over the heat retaining housing 50 while a short stove pipe 55, with a damper 59, is attached to the ash retaining unit 54 together with the funnel conduit 45 inside of the ash retainer. The short stove pipe 55 is connected to the exit stove pipe 56 which allows the smoke and unwanted gases to vent into the chimney 41. The damper 59 is provided with safety holes of size for safe escape of gases under all conditions when the damper is closed and without excessive loss of heat.

Referring to FIG. 3, a means to provide outside air to the stove chamber is provided in the form of an air inlet 62, which may be constructed from a small diameter stove pipe, connected into the ash compartment 25. The air inlet 62 is connected by suitable means known in the art to the outside of the house which provides a source of air into the ash compartment 25 which increases the burning efficiency of the coal fire.

Near the top left-hand side of the furnace 20 a humidifier 63 is attached by suitable means to the steel sheet cover 34 of the exterior of the furnace. The humidifier 63 is of a type known in the art and should have a capacity of producing a relative humidity of 40 to 60 percent since this is the most favorable from a health standpoint.

Figure 9:
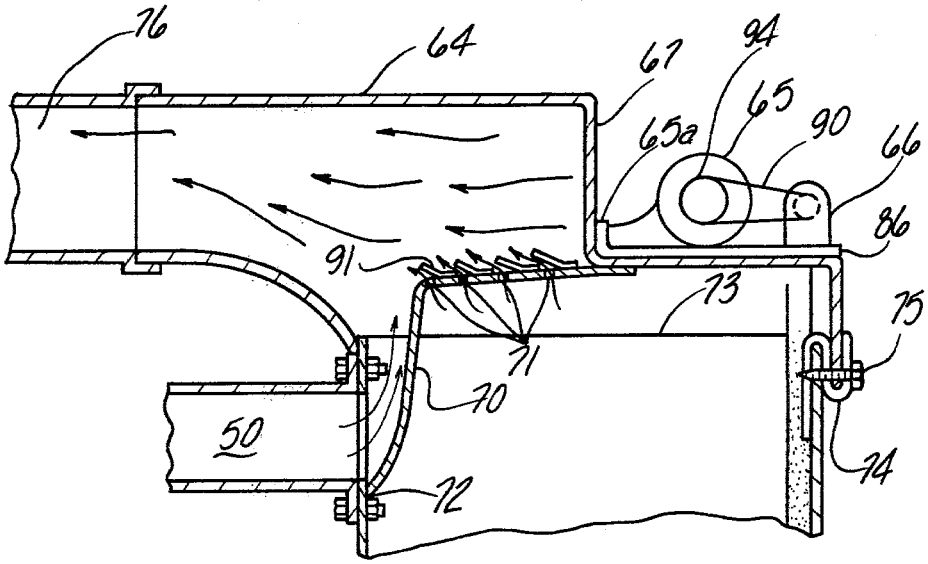
FIG. 9 is a sectional view taken in the direction of the arrows on the section line 9—9 of FIG. 2, showing the top part of the furnace with the plenum.

Referring to FIG. 9, there is shown the top part of the furnace, generally referred to as the furnace plenum 64, which is constructed from light sheet steel and which forms the upper wall of the heat chamber 22.

Figure 10:
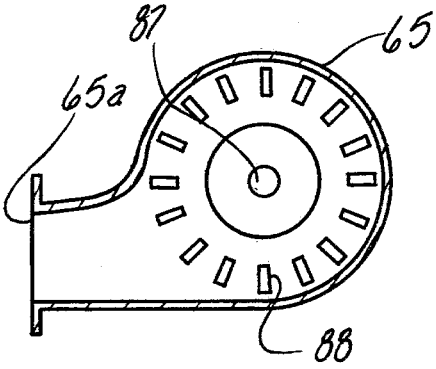
FIG. 10 is a sectional view taken in the direction of the arrows on the section line 10—10 of FIG. 3.
Figure 11:
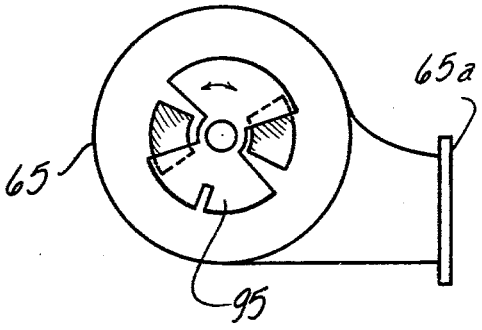
FIG. 11 is an elevational view of the blower of FIG. 10 showing the adjustable air intake thereof.

On the plenum divider 67 there is provided a means to circulate air in the heat chamber. A blower 65 is attached to the plenum divider 67 and mounted to platform 86 in any suitable fashion and has an inlet 65a at the bottom of the divider 67 just above the curved dividing plate 70. The blower 65 is operated by the electric motor 66 attached to a platform 86 mounted to the plenum 64 as shown in FIG. 9. The blower 65 should generally be of a standard construction having a plurality of veins 88 mounted for rotation about a shaft 87. The shaft 87 is rotated by the pulley 94 which is connected by the V-belt 90 to the motor 66. Although the blower may be of standard construction, its configuration should be such that there is substantially a straight path for exiting the blower as shown by the arrows in FIG. 10.

An adjustable inlet vent 95 is provided on the blower to regulate the amount of outside air which may enter the plenum 64. The air entering the plenum from the blower 65 is caused to pass over the deflectors 91 mounted over the openings 71 in the curved dividing plate 70. By virtue of the shape and placement of the deflectors 91, the possibility of back-flow through the openings 71 is prevented, and in operation the deflectors 91 help create a vacuum at the openings to aid in the removal of the heated air from the upper portion of the heat chamber.

The curved dividing plate is provided with finger like segments 72 extending between the spaces in the tubing unit 36 terminating at the rear wall of the furnace and otherwise terminating at the top of the refractory plates 73. Due to the proximity and configuration of the curved dividing plate 70 at the rear of the furnace, an updraft will be created which together with the fan located in the housing 97 forcing hot air through nozzles 53 from spaces between the heat tubing unit 36 and the heat retaining housing 50 into furnace plenum 64.

Thus, complete circulation is provided throughout the heat chamber and the heat retaining housing 50 so that the heated air which is adjacent the portion of the tubing unit 36 which extends outside of the forced-air furnace 20 is captured at the last moment before venting into the funnel-shaped conduit 45, the air around the tubing unit 36 and the refractory plate 73 adjacent to the lower portion of the plenum 64 which is not immediately adjacent the openings in the curved divider plate 70 is caused to flow around the bottom of the plate by virtue of the vacuum created by the blower 65 flowing air over the deflectors 91 and thus aiding in the natural convection flow of heat into the plenum 64 through the openings 71 where it is forced by the blower 65 into the duct 76 where it is distributed through various ducts through the various rooms of the house.

Figure 12:
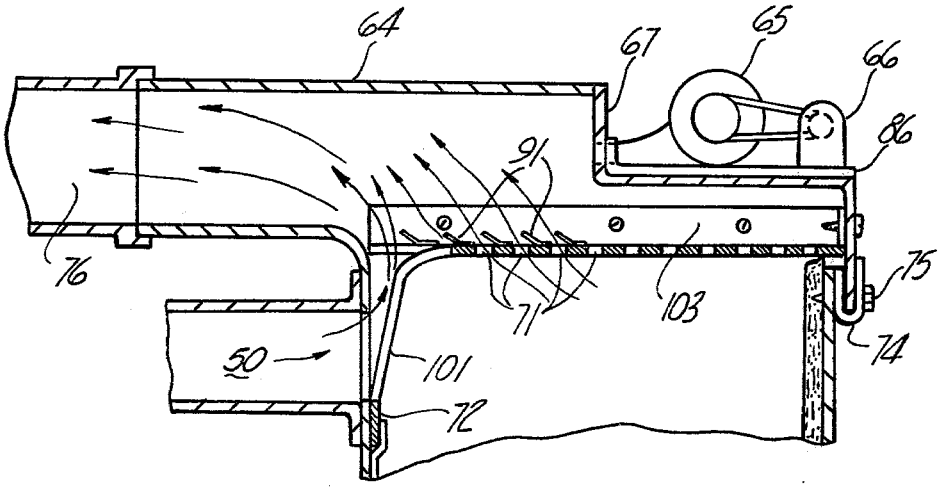
FIG. 12 is a view very similar to FIG. 9, showing a modification of the top part of the furnace with the plenum.
Figure 13:
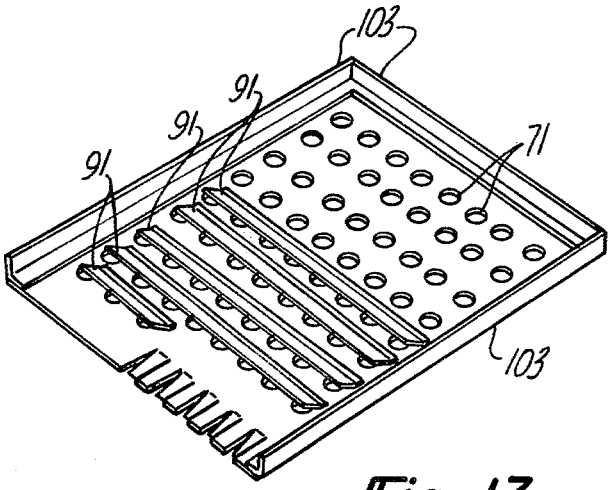
FIG. 13 is a perspective view of the plate shown in FIG. 12.

A modified divider plate 101 shown in FIG. 12 serves the same function as the curved divider plate 70, but has been found to be more efficient under certain conditions when high capacities are needed. The main difference between plate 101 and plate 70 are the additional holes provided in the plate and the additional deflectors 91 shown thereon. A plurality of angles 103 support the plate 101.

The completed plenum 64 assembly is placed on the top of the forced-air furnace 20.

The plenum 64 is of a sufficient inside dimension to tightly slip over the exterior steel sheet covering 34 of the forced-air furnace 20, into a tight fitting, spot welded to outside of furnace 20, U-shaped lip retainer 74, and is then securely fastened together with self-tapping metal screws 75. The end of the plenum 64 is then connected to hot air duct 76 by suitable means known in the art to provide a means for the heated air to leave the heat chamber.

Figure 7:
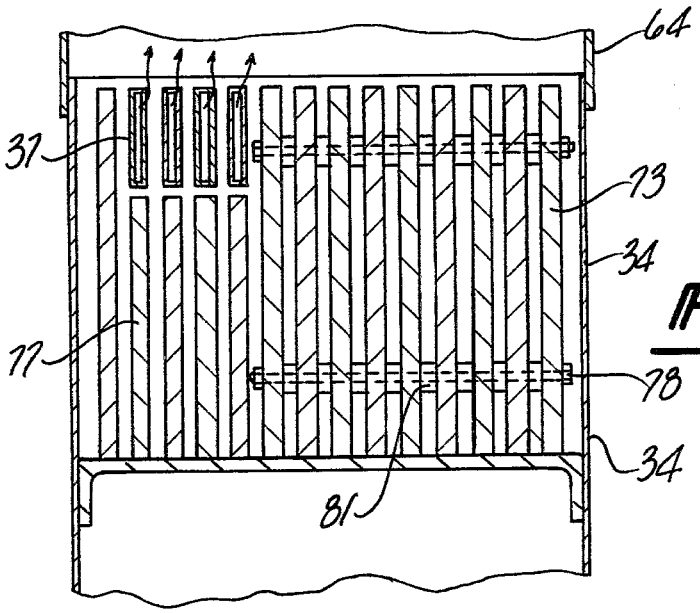
FIG. 7 is a sectional view taken in the direction of the arrows on the section line 7—7 of FIG. 4, near the rear of the furnace, showing the outlet of the hollow plate flue tubing unit and the refractory plates therein.
Figure 8:
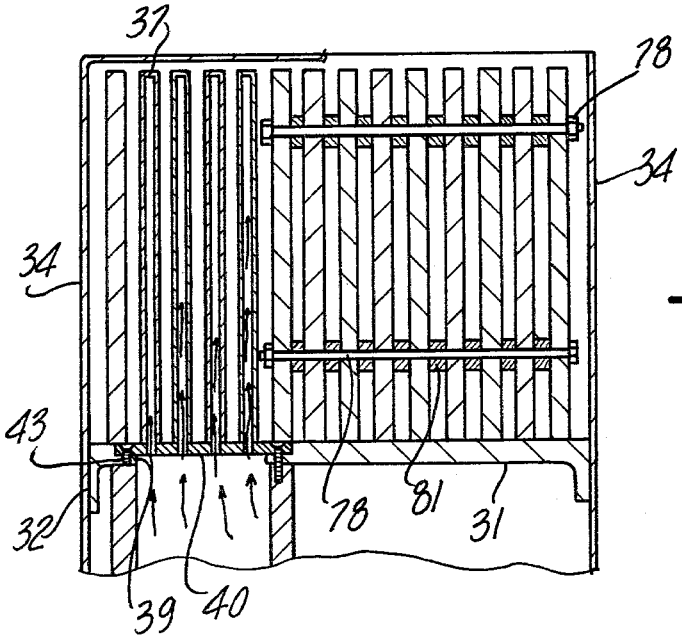
FIG. 8 is a sectional view taken in the direction of the arrows on the section line 8—8 of FIG. 4 near the front of the present invention showing the inlet of hollow tubing unit and the refractory plates therein.

Referring now to FIGS. 7 and 8 which show sectional views, both elevational and plan, of the interior of the heat chamber 22, both the large refractory plates 73 and the small refractory plates 77 are readily visisble. The refractory plates 73, 77 completely fill the inner empty cavity of the heat chamber 22 for both its height and width. The necessity for a large and small refractory plate 73, 77 is obvious since the space under the tubing unit 36 could not otherwise be properly filled.

The thickness of the refractory plates 73, 77 varies with the type of fuels used and the heating demand placed on the furnace. Applicant has found that heavy thickness is preferred for coal and wood fueled fires and thinner thickness for gas or oil fueled fires.

The refractory plates 73, 77 are placed in a serial arrangement within the heat chamber 22 with spaces provided between them. The refractory plates 73, 77 are held together by bolts 78 with spacers 81 between each plate. The purpose of the spacers 81 between each refractory plate is to allow space for efficient air circulation within the furnace heat chamber 22, so that the energy transmitted by the hot gases as they enter the heat chamber via the specially designed flue tubing unit 36 may be easily stored, and heat drawn from them when the blower and fan are activated.

The refractory plates 73, 77 are constructed of materials known in the art, the thinner ones used with gas and oil furnaces are reinforced with screen. They are chosen for particular applications depending on the size and capacity of the furnace being constructed, with particular attention being paid to the heat retaining and heat transfer characteristics.

Once the refractory plates 73, 77 are assembled they are placed in position between steel angles 33 fastened at steel plate 31 surrounding the tubing unit 36 in the heat chamber 22. After the refractory plates 73, 77 are properly positioned within the heat chamber 22, they are placed between angles (not shown) which are fastened to their upper edges.

It is readily apparent that these refractory plates 73, 77 during the operation of the forced-air furnace 20, are absorbing heat both by convection (air being heated as the hot gases pass through the tubing unit 36) and conduction (contact with floor of heat chamber 22). The result being that heat which would normally be wasted is being captured and stored within the refractory plates 73, 77 and then later used.

As noted before, improved forced-air furnace is adapted to be used with a variety of fuels merely by removing coal and wood burning stove from the stove chamber 23 and mounting gas or oil burning unit in its place. I will first describe the operation of the furnace with coal and wood.

As fire is started in stove with some loose paper topped with kindling wood and coal, the damper 49 and ash compartment door 30 of the stove chamber 23 fully open, smoke and gases emanating from the fire are drawn by drafts created through the heat tubing unit 36, pass through ash collector unit 54 (where ashes not drawn through to chimney are retained), thence through the stove pipe 55 to the chimney 41 and out of the house. When added coal or wood in the furnace is in glow, the ash compartment door 30 and damper 49 are closed for the slowly burning fire. Meanwhile, the air in the furnace is heated by outer surface area of heat tubing unit 36 and as by thermostat controls the electric motor connected to the blower mounted to the platform 86, heated air drawn from the heat chamber is forced to a distributing duct and into the rooms of the house together with heated air forced by small electric fan 96 into plenum from heat tubing unit enclosed in the housing. The electric motor driving the blower and the small electric fan are activated and stopped at the same time by the thermostat. Thus, it can be seen that generated heat is retained in the house by this process, and whatever heat escapes through to the chimney together with smoke and gases is more than compensated for by heat drawn from the surface area of the refractory plates previously heated. They are an important contribution to the efficiency of the furnace because at all times while furnace is fired they are absorbing heat. This is especially desirable with coal and wood burning furnaces when, during intervals when the blower is off, they are absorbing heat to be drawn on later.

It can be seen that the furnace described will operate adequately with slowly burning fires using less coal or wood, thereby requiring less expense to heat the house, less attention to furnace and, of course, causing less air pollution because less coal or wood is burned to keep the house in comfortable warmth.

The process of operating my furnace when fueled with gas or oil is the same as with coal and wood using some furnace altogether outside of replacing the stove with a gas or oil burner, providing the furnace with thinner refractory plates, the ash retainer is removed, and the damper is more precisely made and operated for retaining heat in the house and for the safe operating of the furnace.

It can be seen from the preceding description that my novel energy saving forced-air furnace is capable of being fired by any of today's common fuels with some minor changes of the furnace. Thus, by abandoning the previous construction of forced-air furnaces, where approximately half the heat generated escapes through the chimney, I have, by storing and using the energy contained in the hot gases, achieved the objects of the present invention, and numerous additional advantages.

I claim:

1. A furnace including a housing, a refractory supporting plate mounted within said housing and adapted to divide it into an upper heat chamber portion and a lower portion, an opening provided in said refractory supporting plate, a stove chamber mounted in said lower portion and communicating with said opening, a tubing unit having an upper and a lower end mounted in said heat chamber with said lower end sealingly communicating with said stove chamber and said upper end sealingly communicating with the exterior of said housing thereby providing a tubing unit sealed from said heat chamber and communicating with said stove chamber, a plenum forming the top wall of said housing, means to introduce air into said heat chamber, means to exit air from said heat chamber, means to circulate air from said entrance to said exit, and a plurality of serially spaced heat storing solid refractory plates operatively mounted in the space in said heat chamber between said housing and said tubing unit and extending between said refractory supporting plate and said end of said tubing unit wherein said tubing unit includes an upper spacer plate, a plurality of hollow right angle flue tubes of rectangular cross section having upper and lower ends fastened to said upper spacer plates at their upper end, and a lower spacer plate complimentary in shape to said opening in said refractory supporting plate fastened to the lower end of said flue tubes wherein said upper ends of said right angle flue tubes extend outside said furnace housing and are contained in a heat retaining housing attached to said furnace housing.

2. The apparatus defined in claim 1, wherein said housing includes a structural framework formed by a plurality of vertically extending steel angles, a plurality of flanges on said divider plate to form a mounting means for said divider plate, and sheet steel fixedly mounted to the framework thus formed to form side walls for said housing.

3. The device defined in claim 1, wherein both said lower spacer plate and said opening in said divider plate are flanged to permit sealing engagement between said lower spacer plate, said divider plate and said stove chamber.

4. The apparatus defined in claim 3, wherein said lower spacer plate, said divider plate and said stove chamber are connected by suitable fastening means.

5. The device defined in any one of claims 1, 2, 3 or 4, wherein said stove chamber includes a cast body portion having bottom and side walls, a grate dividing said chamber into two portions, a filler door provided on one of said side walls above said grate, an ash compartment door provided in one of said side walls below said grate, and grate shaking means operatively connected to said grate.

6. The apparatus defined in claim 5, wherein said means to admit air into said heat chamber include an opening provided in one of said side walls of said furnace at the lower extremity of said heat chamber immediately above said refractory supporting plate, and a cold air return communicating therewith.

7. The apparatus defined in claim 6, wherein said means to circulate air through said heat chamber include a divider plate on said plenum, a blower operatively mounted to said refractory supporting plate across the entire width thereof, a platform adapted to receive a motor and a blower mounted to the top of said plenum, and a suitable motor mounted to said platform and operatively connected to said blower, all adapted to cause outside air to enter said plenum when said blower is in operation.

8. The apparatus defined in claim 7, wherein said means for exiting air from said heat chamber include a heat retaining housing surrounding the portion of said tubing unit extending past the side walls of the furnace and sealingly attached to said side wall, a short stove pipe sealingly connected to said housing and communicating with an exit stove pipe, an ash collector attached to said housing, a funnel-shaped housing sealingly connected at one end thereof to both said upper spacer plate and said housing, and at the other end to said short stove pipe.

9. The apparatus defined in claim 8, and including a damper mounted in said stove pipe, said damper having a plurality of holes provided therein to provide for the safe operation of said furnace.

10. The apparatus defined in claim 9, and including a humidifier mounted on one of said side walls of said furnace.

11. The apparatus defined in claim 10, and including a plurality of air vents mounted to said heat retaining housing unit.

12. A furnace including a housing, a refractory supporting plate mounted within said housing and adapted to divide it into an upper heat chamber portion and a lower portion, an opening provided in said plate, a stove chamber mounted in said lower portion and communicating with said opening, a tubing unit having an upper and a lower end mounted in said heat chamber with said lower end sealingly communicating with said stove chamber and said upper end sealingly communicating with the exterior of said housing thereby providing a tubing unit sealed from said heat chamber and communicating with said stove chamber, a plenum forming the top wall of said housing, means to introduce air into said heat chamber, means to exit air from said heat chamber, means to circulate air from said entrance to said exit and a plurality of serially spaced heat storing refractory plates operatively mounted in the space in said heat chamber between said housing and said tubing unit and extending between said plate and said end of said tubing unit, wherein said tubing unit includes an upper spacer plate, a plurality of hollow right angle flue tubes of rectangular cross section having upper and lower ends welded to said upper spacer plate at their upper end, and a lower spacer plate complimentary in shape to said opening in said plate welded to the lower end of said flue tubes, wherein said means for exiting air from said heat chamber include a heat retaining housing surrounding the portion of said tubing unit extending past the side walls of the furnace and sealingly attached to said side wall, a short stove pipe sealingly connected to said housing and communicating with an exit stove pipe, an ash collector attached to said housing, a funnel-shaped housing sealingly connected at one end thereof to both said upper spacer plate and said housing, and at the other end to said short stove pipe, wherein said means to circulate air through said heat chamber include a divider plate on said plenum, a blower operatively mounted to said plate across the entire width thereof, a platform adapted to receive a motor and a blower mounted to the top of said plenum, and a suitable motor mounted to said platform and operatively connected to said blower, all adapted to cause outside air to enter said plenum when said blower is in operation, and including a curved divider plate mounted to the inside of said plenum, holes provided in said curved divider plate at the upper curvature thereof, deflector means mounted to said divider plate and extending over said holes and finger-like segments provided in the portion of said curved divider plate over said tubing unit and having said finger-like segments extending forwardly and nearly tangentially to the rear of the furnace between said rectangular flue tubes and being attached to said rear wall proximate said heat retaining housing.

13. The device defined in any one of claims 1, 2 or 3–12 wherein said stove chamber is removed and is replaced by a suitable oil burning unit and said ash collector unit is removed from said heat retaining housing.

14. The apparatus defined in claim 12, wherein said stove chamber is removed and is replaced by a suitable gas burning unit and said ash collector unit is removed from said heat retaining housing.

15. The apparatus defined in claim 14, and including a housing enclosing said air vents and having an opening therein communicating with the atmosphere, and a fan mounted in said opening and adapted to operate when said blower is operating.

* * * * *